US008936687B2

(12) United States Patent
Sadahiro

(10) Patent No.: US 8,936,687 B2
(45) Date of Patent: Jan. 20, 2015

(54) METHOD FOR MANUFACTURING GRAIN ORIENTED ELECTRICAL STEEL SHEETS

(75) Inventor: Kenichi Sadahiro, Kurashiki (JP)

(73) Assignee: JFE Steel Corporation, Tokyo (JP)

( * ) Notice: Subject to any disclaimer, the term of this patent is extended or adjusted under 35 U.S.C. 154(b) by 146 days.

(21) Appl. No.: 13/576,010

(22) PCT Filed: Mar. 9, 2011

(86) PCT No.: PCT/JP2011/056127

§ 371 (c)(1),
(2), (4) Date: Jul. 30, 2012

(87) PCT Pub. No.: WO2011/111862

PCT Pub. Date: Sep. 15, 2011

(65) Prior Publication Data

US 2012/0298265 A1 Nov. 29, 2012

(30) Foreign Application Priority Data

Mar. 12, 2010 (JP) ..... 2010-055916

(51) Int. Cl.

| | |
|---|---|
| ***C21D 8/00*** | (2006.01) |
| ***C21D 8/12*** | (2006.01) |
| ***B21B 3/02*** | (2006.01) |
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/16*** | (2006.01) |
| ***C22C 38/60*** | (2006.01) |
| ***H01F 1/16*** | (2006.01) |

(52) U.S. Cl.

CPC ..... *C21D 8/1222* (2013.01); *B21B 3/02* (2013.01); *C21D 6/008* (2013.01); *C21D 8/1233* (2013.01); *C21D 8/1266* (2013.01); *C21D 8/1272* (2013.01); *C22C 38/001* (2013.01); *C22C 38/008* (2013.01); *C22C 38/02* (2013.01); *C22C 38/04* (2013.01); *C22C 38/06* (2013.01); *C22C 38/12* (2013.01); *C22C 38/16* (2013.01); *C22C 38/60* (2013.01); *H01F 1/16* (2013.01); *C21D 8/1255* (2013.01); *C21D 8/1261* (2013.01); *C21D 8/1283* (2013.01); *C21D 2201/05* (2013.01)

USPC ..... 148/603; 148/504; 148/111; 148/112

(58) Field of Classification Search

None

See application file for complete search history.

(56) References Cited

U.S. PATENT DOCUMENTS 5,667,598 A 9/1997 Ozaki et al.

FOREIGN PATENT DOCUMENTS

| | | |
|---|---|---|
| JP | A-4-301035 | 10/1992 |
| JP | A-8-100216 | 4/1996 |

OTHER PUBLICATIONS

International Search Report issued in International Patent Application No. PCT/JP2011/056127 dated Jun. 21, 2011.

*Primary Examiner* — Deborah Yee

(74) *Attorney, Agent, or Firm* — Oliff PLC

(57) ABSTRACT

In a method for manufacturing grain oriented electrical steel sheets from a slab, controlling the steel sheet temperature so as to satisfy T (t)<FDT−(FDT−700)×t/6 (wherein T (t): steel sheet temperature (° C.), FDT: finishing temperature (° C.) and t: time (sec) after the completion of finish rolling) throughout the entire length of a coil during cooling after the completion of finish rolling in hot rolling, and controlling the steel sheet temperature of a tip portion of the coil representing 10% of the length of the coil to be not less than 650° C. at a lapse of 3 seconds from the completion of hot rolling, thus manufacturing a grain oriented electrical steel sheet exhibiting excellent magnetic properties throughout the entire coil length.

2 Claims, 1 Drawing Sheet

METHOD FOR MANUFACTURING GRAIN ORIENTED ELECTRICAL STEEL SHEETS

TECHNICAL FIELD

The present invention relates to a method for manufacturing grain oriented electrical steel sheets. In particular, the invention relates to a method for manufacturing grain oriented electrical steel sheets that exhibit a low iron loss and a high magnetic flux density throughout the entire length in a coil longitudinal direction.

BACKGROUND ART

Grain oriented electrical steel sheets are widely used mainly as iron core materials for transformers and electrical instruments. They are required to exhibit excellent magnetic properties, for example to be low in terms of iron loss value and high in magnetic flux density. In general, grain oriented electrical steel sheets are manufactured through the following steps. A slab with a thickness of 100 to 300 mm that has been controlled so as to have a predetermined chemical composition is heated to a temperature of 1250° C. or above and subjected to hot rolling, and the resultant hot-rolled sheet is annealed as required. Thereafter, the hot-rolled sheet or the hot-rolled and annealed sheet is cold rolled one time or is cold rolled two or more times with intermediate annealing performed in between, thereby forming a cold-rolled sheet with a final sheet thickness. Thereafter, the cold-rolled sheet is subjected to decarburization annealing. An annealing separator is then applied to the surface of the steel sheet, and the steel sheet is subjected to finish annealing for secondary recrystallization and purification.

That is, a general method for the manufacturing of grain oriented electrical steel sheets attains desired magnetic properties by the following treatments. First, a slab whose properties such as chemical composition associated with the formation of inhibitors have been appropriately controlled is heated to a high temperature in order to completely dissolve inhibitor-forming elements. Thereafter, the slab is hot rolled, subsequently cold rolled one time or two or more times, and further annealed one time or two or more times, thereby appropriately controlling the obtainable primary recrystallized microstructure. The steel sheet is then subjected to finish annealing where the primary recrystallized grains are secondarily recrystallized into {110}<001> oriented (Goss oriented) crystal grains.

In order to effectively promote the secondary recrystallization, firstly, it is important to control the precipitation state of a dispersed phase called an inhibitor such that the inhibitor will be dispersed uniformly with an appropriate size throughout the steel in order to suppress the growth (the normal grain growth) of the primary recrystallized grains during finish annealing. Then, of importance is that the primary recrystallized microstructure is formed of appropriately sized crystal grains with a uniform distribution across the sheet thickness. Typical inhibitors are substances exhibiting extremely low solubility in steel, with examples including sulfides, selenides and nitrides such as MnS, MnSe, AlN and VN. Grain boundary segregating elements such as Sb, Sn, As, Pb, Ce, Te, Bi, Cu and Mo are also used as inhibitors. In any event, controlling the behavior of inhibitors from the precipitation of inhibitors during hot rolling until the secondary recrystallization annealing is of importance in order to obtain a satisfactory secondary recrystallized microstructure. Such inhibitor control is becoming more important in order to ensure more excellent magnetic properties.

From the viewpoint of controlling inhibitor precipitation, a technique disclosed in Patent Literature 1 focuses on the influences of the temperature history from finish rolling to coiling in a hot rolling step on the magnetic properties of grain oriented electrical steel sheets. In a method according to this technique, a steel slab is hot rolled while controlling the finishing temperature (finishing delivery temperature) to be in the range of 900 to 1100° C., cooled under conditions such that the steel sheet temperature at a lapse of 2 to 6 seconds from the completion of the finish rolling satisfies Equation (1) below, and coiled at not more than 700° C.:

$$T(t)<FDT-(FDT-700)\times t/6 \quad (1)$$

wherein T (t): steel sheet temperature (° C.), FDT: finishing temperature (° C.) and t: time (sec) after the completion of finish rolling in hot rolling.

CITATION LIST

Patent Literature

[PTL 1] Japanese Unexamined Patent Application Publication No. 8-100216

SUMMARY OF INVENTION

Technical Problem

According to the technique disclosed in Patent Literature 1, the upper limit temperature of a steel sheet is appropriately controlled during a cooling process from after the completion of finish rolling until coiling so that an undesired precipitation state of inhibitors is prevented, thereby lowering the secondary recrystallization defective rate and realizing a high magnetic flux density and a low iron loss. This technique contributes to the stabilization of the quality of grain oriented electrical steel sheets.

Even with the full use of this technique, however, a tip portion of a hot-rolled sheet, in particular a tip portion representing 5 to 10% of the entire coil length tends to become approximately 10% lower in terms of magnetic properties, in particular iron loss properties, compared to a middle portion of the coil. Thus, a quality problem still remains to be addressed.

The present invention has been made in view of the problems in the art described above. It is therefore an object of the invention to provide an advantageous method capable of manufacturing grain oriented electrical steel sheets that exhibit excellent magnetic properties throughout the entire length of a coil.

Solution to Problem

In order to solve the above-described problems, the present inventors carried out studies focusing on the production history in a hot-rolled coil along its longitudinal direction. As a result, they have confirmed the following. First, in the case of batchwise hot rolling, namely, hot rolling where coils are singly rolled, the sheet thickness of a tip portion of a coil frequently becomes deviated from a target sheet thickness by approximately 10% even according to the current computerized high-level predictive control. Further, since a tip portion of a coil is rolled at a low speed until the coil tip becomes wound around a coiler, this portion is excessively cooled compared to a middle portion of the coil that is rolled at a higher speed, thus the tip portion being overcooled.

The present inventors carried out further studies based on the above results. It has been then found necessary to control not only the upper limit temperature as disclosed by the technique of Patent Literature 1 but also the lower limit temperature in order to prevent a tip portion of a hot-rolled coil from being deteriorated in terms of magnetic properties. The present invention has been completed based on this finding.

An aspect of the present invention is therefore directed to a method for manufacturing grain oriented electrical steel sheets with excellent magnetic properties, including a series of steps in which a steel slab containing C at 0.01 to 0.10 mass %, Si at 2.5 to 4.5 mass %, Mn at 0.02 to 0.12 mass %, Al at 0.005 to 0.10 mass % and N at 0.004 to 0.015 mass %, as well as one or two selected from Se at 0.005 to 0.06 mass % and S at 0.005 to 0.06 mass %, is heated to a temperature of not less than 1280° C. and hot rolled, the hot-rolled sheet is optionally annealed as required and is cold rolled one time or is cold rolled two or more times with intermediate annealing performed in between into a final sheet thickness, and the cold-rolled sheet is subjected to decarburization annealing and finish annealing, the method including controlling the steel sheet temperature so as to satisfy Equation (1) below throughout the entire coil length during cooling after the completion of finish rolling in the hot rolling:

$$T(t)<FDT-(FDT-700)\times t/6 \quad (1)$$

wherein T (t): steel sheet temperature (° C.), FDT: finishing temperature (° C.) and t: time (sec) after the completion of finish rolling;

the method including controlling the steel sheet temperature of a tip portion of the coil representing 10% of the length of the coil so as to be not less than 650° C. at a lapse of 3 seconds from the completion of the hot rolling.

In the method for manufacturing grain oriented electrical steel sheets according to the invention, the steel slab may further contain, in addition to the above components, one, or two or more selected from Cu: 0.01 to 0.15 mass %, Sn: 0.01 to 0.15 mass %, Sb: 0.005 to 0.1 mass %, Mo: 0.005 to 0.1 mass %, Te: 0.005 to 0.1 mass % and Bi: 0.005 to 0.1 mass %.

Thus, the composition of the steel slab used in the invention can be summarized to include C: 0.01 to 0.10 mass %, Si: 2.5 to 4.5 mass %, Mn: 0.02 to 0.12 mass %, Al: 0.005 to 0.10 mass % and N: 0.004 to 0.015 mass %, as well as at least one selected from Se: 0.005 to 0.06 mass % and S: 0.005 to 0.06 mass %, and optionally at least one selected from Cu: 0.01 to 0.15 mass %, Sn: 0.01 to 0.15 mass %, Sb: 0.005 to 0.1 mass %, Mo: 0.005 to 0.1 mass %, Te: 0.005 to 0.1 mass % and Bi: 0.005 to 0.1 mass %, the balance being preferably represented by Fe and inevitable impurities.

Advantageous Effects of Invention

According to the present invention, grain oriented electrical steel sheets containing at least one of MnSe and MnS, as well as AlN as inhibitors can be manufactured without the problems encountered in the background art in which a longitudinal tip portion of a hot-rolled coil exhibits lower magnetic properties. Thus, grain oriented electrical steel sheets that exhibit excellent magnetic properties throughout the entire length of a coil can be manufactured.

DESCRIPTION OF EMBODIMENTS

Hereinbelow, a method for manufacturing grain oriented electrical steel sheets according to the present invention will be described.

A feature of manufacturing method of the invention lies in that the conditions of cooling after the completion of hot rolling are optimized as will be described later. The inventive method is not particularly limited except in that the conditions of cooling after hot rolling are controlled to be within optimized ranges described later. Thus, known conditions may be adopted for other manufacturing steps, for example steel making, hot rolling, hot-rolled sheet annealing, pickling, intermediate annealing, cold rolling, decarburization annealing, annealing separator application and finish annealing.

Basic technical ideas of the present invention will be described below.

As described hereinabove, studies carried out by the present inventors have revealed that in the case of batchwise hot rolling where coils are singly rolled, the sheet thickness of a tip portion of a coil frequently becomes deviated from a target sheet thickness by approximately 10% and, because such a coil tip portion is rolled at a low speed until the coil tip becomes wound around a coiler, the portion is frequently overcooled compared to a middle portion of the coil that is rolled at a higher speed.

Figure 1:
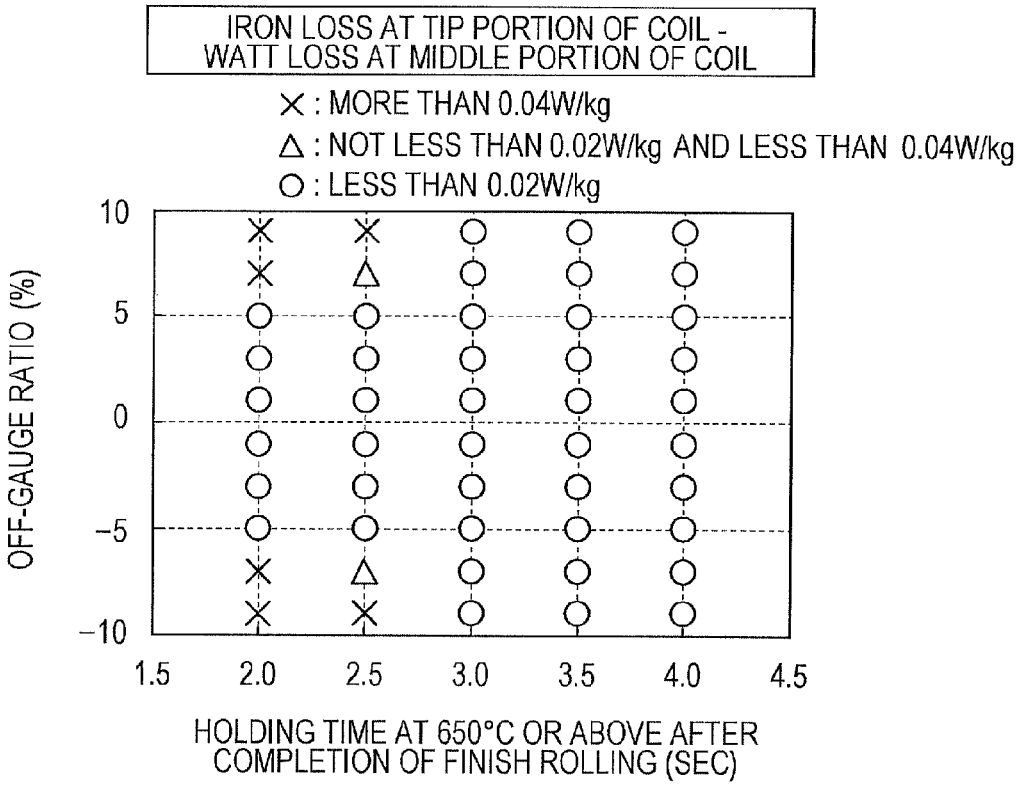
FIG. 1 is a graph showing influences of the holding time at 650° C. or above after the completion of finish hot rolling (abscissa: sec) and the sheet thickness deviation (ordinate: off-gauge ratio (%)) on the difference in iron loss between a tip portion and a middle portion of a hot-rolled coil.

Studies were then carried out with respect to hot-rolled coils differing in terms of sheet thickness and cooling state of coil tip portions, in order to examine influences of the time (the holding time) for which the rolled sheet is held at 650° C. or above after the completion of finish rolling and the sheet thickness deviation relative to a target sheet thickness, on the difference in iron loss between a tip portion and a middle portion of the hot-rolled coil. The studies led to a new finding that, as illustrated in FIG. 1, coils had a large difference in iron loss between a tip portion and a middle portion (that is, a marked deterioration of iron loss in the tip portion) when the deviation of the sheet thickness of the coil tip portion was greater than ±5% as well as when the coil had become cooled so rapidly to below 650° C. after the completion of finish rolling that the holding time at 650° C. or above was less than 3 seconds.

The results in FIG. 1 were obtained by testing a large number of grain oriented electrical steel sheets that had been prepared from various kinds of steel slabs satisfying the composition requirement described later (iron loss values of coil middle portions (in the rolling direction) ranging from 0.72 to 0.84 W/kg).

The sheet thickness deviation was evaluated by measuring the deviation (the off-gauge ratio) of the sheet thickness of a tip portion from a target sheet thickness (a target average thickness in a coil middle portion along a longitudinal direction) as defined in EXAMPLES later.

The time after the completion of finish rolling was counted starting from when the steel sheet came out of the final pair of rolling rolls of a finish rolling mill.

The present inventors assume the reasons for the above results as follows.

According to the conventional art disclosed in Patent Literature 1, the upper limit temperature of a steel sheet at a lapse of 2 to 6 seconds from the completion of finish rolling is controlled so as to suppress the coarsening of inhibitors, thereby preventing a decrease in magnetic properties. However, in the event that a steel sheet is excessively cooled after the completion of finish rolling, inhibitors are precipitated so finely that the inhibiting power of such inhibitors becomes excessively strong. Further, because dynamic recrystallization does not proceed when a finish-rolled steel sheet is quenched, the amount of (111) orientation that is necessary for the encroachment and growth of Goss orientation during secondary recrystallization is decreased while the amount of (200) orientation that is detrimental to such encroachment and growth is increased. These factors make stable secondary recrystallization difficult, and as a result iron loss properties are deteriorated. That is, it has been found that controlling the upper limit temperature over the entire length of a coil causes a problem in that a tip portion of the hot-rolled coil that has a relatively low steel sheet temperature can be excessively cooled.

Further, a target sheet thickness in hot rolling is generally set at an optimum value taking into consideration influences of the cold rolling draft on the steel sheet microstructure formed afterward. That is, any larger or smaller sheet thickness than the target value cannot ensure an appropriate cold rolling draft. As a result, magnetic properties tend to be lowered.

Such deteriorations in iron loss are considered to become more serious if the above two adverse effects are present at the same time, namely, if a finish-rolled steel sheet is quenched so rapidly that the steel sheet temperature falls below 650° C. within 3 seconds after the completion of finish rolling, in other words, the holding time at 650° C. or above becomes less than 3 seconds, and further if the steel sheet thickness is deviated from a target sheet thickness so greatly that the cold rolling draft goes out of an appropriate range.

From the above-discussed results, it has been shown effective to control not only the upper limit but also the lower limit of the steel sheet temperature during cooling when a hot-rolled steel sheet is cooled after the completion of finish rolling, in particular, when a tip portion of a hot-rolled coil which tends to have large deviations in terms of sheet thickness and is apt to be overcooled undergoes a cooling process. That is, it has been found that even if avoiding deviations in sheet thickness is difficult, the aforementioned problems can be prevented by controlling the steel sheet temperature in an appropriate manner during cooling.

Figure 2:
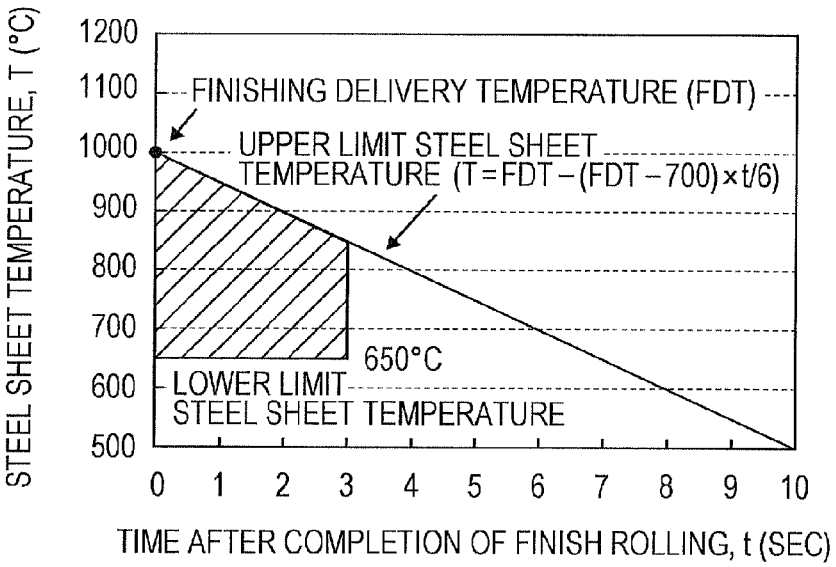
FIG. 2 is a graph showing a range of temperatures within which the temperature of a tip portion of a hot-rolled coil is controlled according to the present invention (ordinate: steel sheet temperature (° C.), abscissa: time after completion of finish rolling (sec)).

According to the invention, deteriorations in the magnetic properties of a tip portion of a hot-rolled coil are prevented by the following method. First, the steel sheet temperature in terms of upper limit temperature is controlled so as to satisfy Equation (1) below throughout the entire coil length during cooling after the completion of finish hot rolling:

$$T(t)<FDT-(FDT-700)\times t/6 \quad (1)$$

wherein T (t): steel sheet temperature (° C.), FDT: finishing temperature (° C.) and t: time (sec) after the completion of finish rolling. Further, the steel sheet temperature in terms of lower limit temperature of a tip portion of the hot-rolled coil (a portion representing 10% of the entire length of the coil) is controlled so as to be not less than 650° C. at a lapse of 3 seconds from the completion of the hot rolling. That is, cooling conditions are controlled such that the steel sheet temperature of such a tip portion of the hot-rolled coil shifts within the shaded area in FIG. 2 while the tip portion is being cooled.

The reason why the temperature history of the steel sheet needs to satisfy Equation (1) during cooling is because any steel sheet temperature which fails to satisfy Equation (1) and shifts in a higher temperature region causes changes in precipitation behaviors of AlN and any of MnSe and MnS with the result that less suppressive and undesired inhibitors are precipitated so as to increase the probability of the occurrence of defective secondary recrystallization, thereby resulting in deteriorated magnetic properties such as high iron loss and low magnetic flux density. That is, it is necessary that Equation (1) be satisfied not only by a tip portion of a hot-rolled coil but by the hot-rolled coil throughout its entire length. In order to prevent excessive coarsening of inhibitors, the steel sheet temperature at a lapse of 3 seconds from the completion of hot rolling is preferably controlled to be 800° C. or below.

The reason why it is necessary to cool the steel sheet such that the steel sheet temperature is not less than 650° C. at a lapse of 3 seconds from the completion of hot rolling, namely, the reason why the steel sheet temperature needs to be held at 650° C. or above for 3 seconds after the completion of hot rolling has been already described. That is, quenching a hot-rolled steel sheet rapidly to below 650° C. results in an excessively high inhibiting power of inhibitors as well as a decrease in the amount of (111) orientation that is necessary for the growth of Goss orientation because any dynamic recrystallization does not proceed with such quenching, thereby suppressing secondary recrystallization from occurring stably.

Holding the steel sheet temperature at not less than 650° C. at a lapse of 3 seconds from the initiation of cooling, namely, for at least 3 seconds, is an essential requirement for a 10% length tip portion of a hot-rolled coil in which the steel sheet temperature is apt to be lowered easily. It is needless to mention that the hot-rolled coil may be held under such cooling conditions throughout its entire length. The lower limit of the cooling conditions for the coil tip portion is not particularly limited after 3 seconds have passed.

In batchwise hot rolling, the sheet thickness of a coil tip portion can be deviated by about ±20% at maximum in some cases. Even in such cases, magnetic properties can be maintained by holding the coil tip portion at 650° C. or above for at least 3 seconds.

Background art such as Patent Literature 1 has studied effects of conditions of cooling after hot rolling on the precipitation behaviors of inhibitors. However, such studies merely simulate behaviors occurring at portions that are manufactured under stable conditions such as a longitudinal middle portion of a coil, and pay no attention to inhibitor precipitation behaviors or dynamic recrystallization behaviors at unsteady portions such as a tip portion of a hot-rolled coil. In contrast, the present invention focuses attention on an unsteady portion at a tip of a hot-rolled coil as described above. The invention has significance in providing a method capable of preventing a decrease in magnetic properties that is a specific phenomenon in such a portion. Indeed, a strengthening of cooling after hot rolling is desirable in order to conform to such an upper limit as described in Patent Literature 1. In such cases, however, it is not rare for a coil tip portion to be cooled to approximately 600° C. within 3 seconds unless cooling of the tip portion is carefully controlled.

In the manufacturing method of the invention, the heating temperature for the slab which is to be hot rolled is preferably not less than 1280° C. in order to ensure that inhibitor-forming elements are dissolved sufficiently. The finishing temperature in hot rolling is preferably 900 to 1100° C., and the coiling temperature after hot rolling is preferably not more than 650° C.

Next, the chemical composition of the grain oriented electrical steel sheet according to the invention will be described.

Steel which is applicable to the manufacturing of grain oriented electrical steel sheets by the inventive method needs to contain AlN and any of MnSe and MnS as inhibitors which are formed by the addition of a combination of such elements. The chemical composition of the steel is described below.

C: 0.01 to 0.10 mass %

Carbon is a useful element not only for the uniformity and size reduction of microstructure during hot rolling and cold rolling, but also for the development of Goss orientation. It is necessary that the slab contain carbon at a content of at least 0.01 mass %. On the other hand, adding carbon in excess of 0.10 mass % results in a difficulty in achieving decarburization in an annealing step, and also causes irregularities in Goss orientation and a consequent decrease in magnetic properties. Thus, the upper limit is 0.10 mass %. The lower limit of the C content is preferably 0.03 mass %, and the upper limit is preferably 0.08 mass %. The C content after finish annealing is preferably not more than 0.004 mass %.

Si: 2.5 to 4.5 mass %

Silicon is an essential element which increases the specific resistance of the steel sheet and contributes to lowering iron loss. If the Si content is less than 2.5 mass %, a sufficient effect of lowering iron loss cannot be obtained; further, the crystal orientation is randomized by $\alpha$-$\gamma$ transformation which takes place during finish annealing performed at a high temperature for secondary recrystallization and purification, thereby failing to provide sufficient magnetic properties. On the other hand, cold rolling properties are deteriorated if the Si content exceeds 4.5 mass %, resulting in difficult production. Thus, the Si content is specified to be in the range of 2.5 to 4.5 mass %. The lower limit is preferably 3.0 mass %, and the upper limit is preferably 3.5 mass %.

Mn: 0.02 to 0.12 mass %

Manganese is an effective element for preventing the occurrence of cracks caused by sulfur during hot rolling. Such an effect cannot be obtained if the Mn content is less than 0.02 mass %. On the other hand, adding manganese in excess of 0.12 mass % results in deteriorations in magnetic properties. Thus, the Mn content is specified to be in the range of 0.02 to 0.12 mass %. The lower limit is preferably 0.05 mass %, and the upper limit is preferably 0.10 mass %.

Al: 0.005 to 0.10 mass %

Aluminum is an element that combines with nitrogen to form AlN functioning as an inhibitor. If the Al content is less than 0.005 mass %, such an inhibitor does not exhibit a sufficient inhibiting power. On the other hand, adding aluminum in excess of 0.10 mass % results in coarsening of the precipitate, thereby lowering the effect. Thus, aluminum is added at a content in the range of 0.005 to 0.10 mass %. The lower limit is preferably 0.01 mass %, and the upper limit is preferably 0.05 mass %.

N: 0.004 to 0.015 mass %

Nitrogen is an element that combines with aluminum to form MN functioning as an inhibitor. If the N content is less than 0.004 mass %, such an inhibitor does not exhibit a sufficient inhibiting power. On the other hand, adding nitrogen in excess of 0.015 mass % results in coarsening of the precipitate, thereby lowering the effect. Thus, nitrogen is added at a content in the range of 0.004 to 0.015 mass %. The lower limit is preferably 0.006 mass %, and the upper limit is preferably 0.010 mass %.

At least one of Se: 0.005 to 0.06 mass % and S: 0.005 to 0.06 mass %

Selenium is an important element that combines with manganese to form MnSe functioning as an inhibitor. Sulfur is an important element that combines with manganese to form MnS functioning as an inhibitor. Thus, at least one of selenium and sulfur is added.

If the Se content is less than 0.005 mass %, the resultant inhibitor does not exhibit a sufficient inhibiting power. On the other hand, adding selenium in excess of 0.06 mass % results in coarsening of the precipitate, thereby lowering the effect. Thus, selenium is added at a content in the range of 0.005 to 0.06 mass % in either case where it is added singly or in combination with sulfur. The lower limit is preferably 0.010 mass %, and the upper limit is preferably 0.030 mass %.

If the S content is less than 0.005 mass %, the resultant inhibitor does not exhibit a sufficient inhibiting power. On the other hand, adding sulfur in excess of 0.06 mass % results in coarsening of the precipitate, thereby lowering the effect. Thus, sulfur is added at a content in the range of 0.005 to 0.06 mass % in either case where it is added singly or in combination with selenium. The lower limit is preferably 0.015 mass %, and the upper limit is preferably 0.035 mass %.

To the grain oriented electrical steel sheet according to the present invention, grain boundary segregating elements such as Cu, Sn, Sb, Mo, Te and Bi may be added in addition to the above inhibitor-forming elements S, Se, Al and N. When these elements are added, they are preferably added at 0.01 to 0.15 mass % for Cu and Sn, and 0.005 to 0.1 mass % for Sb, Mo, Te and Bi. These inhibitor-forming elements may be added singly or in combination with one another.

The balance of the chemical composition is preferably represented by Fe and inevitable impurities.

EXAMPLES

Example 1

A continuously cast silicon steel slab with a thickness of 220 mm and a width of 1200 mm which had a chemical composition described in Table 1 with the balance represented by Fe and inevitable impurities was heated in a usual gas heating furnace and was further heated to 1430° C. in an induction heating furnace, thereby dissolving the inhibitor-forming elements. Thereafter, the steel slab was subjected to rough hot rolling and then finish hot rolled at a finishing temperature of 1000° C., thus forming a hot-rolled sheet having a sheet thickness of 2.4 mm. Subsequently, the hot-rolled sheet was cooled while controlling cooling conditions such that the steel sheet temperature satisfied $T(t) < FDT - (FDT - 700) \times t/6$ throughout the entire coil length and also such that a tip portion of the hot-rolled coil (extending from the tip to 10% of the coil length) had a steel sheet temperature described in Table 2 at a lapse of 3 seconds from the completion of the finish rolling. The steel sheet was then coiled at 550° C. Table 2 also describes deviations from a target sheet thickness of each coil tip portion defined by the equation:

$$\{100(\%) \times (\text{sheet thickness of tip portion} - \text{target sheet thickness})/(\text{target sheet thickness})\}$$

The hot-rolled sheet was annealed and pickled, and was cold rolled two times with intermediate annealing performed one time in between, thereby forming a cold-rolled sheet with a final sheet thickness of 0.23 mm. After grooves for magnetic domain refining were formed by etching, the cold-rolled sheet was subjected to decarburization annealing in a wet hydrogen atmosphere at 850° C. for 2 minutes. An annealing separator MgO-based was applied, and the steel sheet was finish annealed in a hydrogen atmosphere at 1200° C. for 10 hours to give a product (a grain oriented electrical steel sheet).

With respect to the product manufactured as described above, test pieces were sampled from a position corresponding to a hot-rolled coil tip portion (a front tip portion) and from a position corresponding to a middle portion. The test pieces were tested to measure an iron loss $W_{17/50}$ (an iron loss at a frequency of 50 Hz and a maximum magnetic flux density of 1.7 T).

The measurement results are also described in Table 2. The results have shown that INVENTIVE EXAMPLES, in which the steel sheet temperature of the coil tip portion was 650° C. at a lapse of 3 seconds from the completion of finish hot rolling, namely, the coil tip portion was held at a temperature of 650° C. or above for at least 3 seconds, achieved an improvement in the magnetic properties of the coil tip portion to a level comparable to that of the coil middle portion in spite of the fact that the coil tip portion had a large deviation in sheet thickness.

TABLE 1

| Steel | Chemical composition (mass %) | | | | | | | | | | | | |
|---|---|---|---|---|---|---|---|---|---|---|---|---|---|
| code | C | Si | Mn | Al | N | S | Se | Cu | Sn | Sb | Mo | Te | Fe |
| A | 0.072 | 3.30 | 0.070 | 0.026 | 0.0090 | 0.008 | 0.019 | — | — | — | — | — | Bal. |
| B | 0.068 | 3.40 | 0.060 | 0.023 | 0.0085 | 0.009 | 0.016 | 0.10 | — | 0.040 | — | — | Bal. |
| C | 0.075 | 3.35 | 0.072 | 0.022 | 0.0079 | 0.010 | 0.017 | — | 0.120 | — | 0.010 | — | Bal. |
| D | 0.073 | 3.25 | 0.075 | 0.025 | 0.0092 | 0.007 | 0.018 | 0.10 | 0.050 | 0.025 | 0.012 | — | Bal. |
| E | 0.065 | 3.32 | 0.065 | 0.028 | 0.0089 | 0.008 | 0.020 | — | 0.060 | 0.040 | 0.014 | — | Bal. |
| F | 0.078 | 3.18 | 0.068 | 0.029 | 0.0088 | 0.009 | 0.022 | 0.12 | 0.050 | 0.030 | 0.014 | 0.01 | Bal. |
| G | 0.062 | 3.42 | 0.071 | 0.025 | 0.0086 | 0.007 | 0.019 | 0.08 | — | 0.030 | 0.008 | — | Bal. |
| H | 0.069 | 3.35 | 0.060 | 0.026 | 0.0085 | 0.025 | — | — | — | — | — | — | Bal. |
| I | 0.073 | 3.25 | 0.072 | 0.024 | 0.0090 | — | 0.020 | — | — | — | — | — | Bal. |

TABLE 2

| No. | Steel code | Holding time at 650° C. or above (sec) | Maximum off-gauge ratio at tip portion of coil (%) | Magnetic flux density $B_8$ (T) | | Iron loss $W_{17/50}$ (W/kg) | | Difference in iron loss between tip portion and middle portion | Remarks |
|---|---|---|---|---|---|---|---|---|---|
| | | | | Tip portion | Middle portion | Tip portion | Middle portion | | |
| 1 | A | 2.2 | +8 | 1.87 | 1.89 | 0.82 | 0.78 | 0.04 | COMP. EX. |
| 2 | A | 3.5 | +9 | 1.88 | 1.89 | 0.79 | 0.78 | 0.01 | INV. EX. |
| 3 | A | 3.8 | +10 | 1.88 | 1.89 | 0.77 | 0.77 | 0.00 | INV. EX. |
| 4 | B | 2.0 | +6 | 1.88 | 1.91 | 0.83 | 0.79 | 0.04 | COMP. EX. |
| 5 | B | 3.6 | +7 | 1.89 | 1.91 | 0.79 | 0.79 | 0.00 | INV. EX. |
| 6 | C | 2.2 | +8 | 1.87 | 1.90 | 0.84 | 0.79 | 0.05 | COMP. EX. |
| 7 | C | 3.4 | +10 | 1.88 | 1.90 | 0.80 | 0.79 | 0.01 | INV. EX. |
| 8 | D | 1.9 | +7 | 1.86 | 1.89 | 0.85 | 0.78 | 0.07 | COMP. EX. |
| 9 | D | 4.0 | +9 | 1.87 | 1.89 | 0.77 | 0.77 | 0.00 | INV. EX. |
| 10 | E | 2.3 | +8 | 1.88 | 1.91 | 0.82 | 0.79 | 0.03 | COMP. EX. |
| 11 | E | 4.5 | +7 | 1.89 | 1.91 | 0.80 | 0.78 | 0.02 | INV. EX. |
| 12 | F | 2.5 | +6 | 1.87 | 1.90 | 0.80 | 0.76 | 0.04 | COMP. EX. |
| 13 | F | 3.9 | +10 | 1.88 | 1.90 | 0.74 | 0.75 | −0.01 | INV. EX. |
| 14 | G | 2.1 | +9 | 1.85 | 1.89 | 0.79 | 0.73 | 0.06 | COMP. EX. |
| 15 | G | 4.2 | +8 | 1.88 | 1.89 | 0.72 | 0.73 | −0.01 | INV. EX. |
| 16 | H | 3.3 | +7 | 1.89 | 1.90 | 0.70 | 0.72 | −0.02 | INV. EX. |
| 17 | I | 3.6 | +10 | 1.88 | 1.89 | 0.71 | 0.71 | 0.00 | INV. EX. |

INDUSTRIAL APPLICABILITY

According to the present invention, grain oriented electrical steel sheets containing inhibitors exhibit excellent magnetic properties throughout the entire coil length.

The invention claimed is:

1. A method for manufacturing grain oriented electrical steel sheets, comprising a series of steps in which a steel slab containing:

C at 0.01 to 0.10 mass %,

Si at 2.5 to 4.5 mass %,

Mn at 0.02 to 0.12 mass %,

Al at 0.005 to 0.10 mass %,

N at 0.004 to 0.015 mass %, and one or more components selected from Se at 0.005 to 0.06 mass % and S at 0.005 to 0.06 mass %, the steps including:

(a) heating the steel slab to a temperature of not less than 1280° C.;

(b) hot rolling the steel slab to form a steel sheet;

(c) optionally annealing the hot rolled steel sheet;

(d) cold rolling the steel sheet either one time or two or more times so that the steel sheet is formed with a final sheet thickness;

(e) when cold rolling is conducted two or more times in step (d), performing intermediate annealing in between each of the cold rolling steps; and (f) subjecting the cold rolled steel sheet to decarburization annealing and finish annealing, wherein the temperature of the steel sheet is controlled so as to satisfy Equation (1) below throughout an entire length of a coil formed by the steel sheet during cooling of the steel sheet after the completion of the hot rolling in step (b), and the temperature of a tip portion of the coil representing 10% of the length of the coil, where a deviation of sheet thickness is greater than ±5%, is controlled so as to be not less than 650° C. at a lapse of 3 seconds from the completion of the hot rolling in step (b):

$$T(t)<FDT-(FDT-700)\times t/6 \quad \text{Equation (1)}$$

wherein T (t): steel sheet temperature (° C.), FDT: finishing temperature (° C.) and t: time (sec) after the completion of finish rolling.

2. The method for manufacturing grain oriented electrical steel sheets according to claim 1, wherein the steel slab further contains one or more components selected from Cu: 0.01 to 0.15 mass %, Sn: 0.01 to 0.15 mass %, Sb: 0.005 to 0.1 mass %, Mo: 0.005 to 0.1 mass %, Te: 0.005 to 0.1 mass % and Bi: 0.005 to 0.1 mass %.

* * * * *